United States Patent [19]

Wood et al.

[11] Patent Number: 4,566,626

[45] Date of Patent: Jan. 28, 1986

[54] END LOADING CAN CARTON

[75] Inventors: Prentice J. Wood, Hapeville; James R. Oliff, Austell; Richard K. Watkins, Lithonia, all of Ga.

[73] Assignee: The Mead Corporation, Dayton, Ohio

[21] Appl. No.: 716,163

[22] Filed: Mar. 26, 1985

[51] Int. Cl.[4] ..... B65D 5/02

[52] U.S. Cl. ..... 229/37 R; 229/38; 229/17 R

[58] Field of Search ..... 229/37 R, 37 E, 38, 229/39 R, 44 R, 17 R

[56] References Cited

U.S. PATENT DOCUMENTS

| | | | |
|---|---|---|---|
| 3,367,558 | 2/1968 | Farquhar | 229/37 R |
| 3,469,766 | 9/1969 | Nelson | 229/37 R |
| 3,521,744 | 7/1970 | Smith | 229/37 R |
| 3,643,856 | 2/1972 | Jones | 229/37 R |
| 3,729,126 | 4/1973 | Donahue | 229/38 |
| 3,904,036 | 9/1975 | Forrer | 229/38 |
| 4,305,544 | 12/1981 | Noonan | 229/35 |

*Primary Examiner*—Joseph Man-Fu Moy

*Attorney, Agent, or Firm*—Rodgers & Rodgers

[57] ABSTRACT

For preventing damage to the tops and bottoms of end loading stacked can cartons, a reinforcing panel is affixed to the inside surface of the top or bottom walls of the carton or to both such walls so as to prevent coincidental can chimes on the upper ends of cans in a lower carton from damaging the top wall of its associated carton and the bottom wall of a carton stacked thereabove and without which the lower ends of the cans of the upper carton may cooperate with the chimes of the cans in the lower cartons to effect substantial damage to the top of the lower carton and to the bottom of the upper carton. For facilitating entry of the cans into an end loading carton and for preventing damaging engagement between the cans and the reinforcing panels, an inwardly extending embossment may be formed in the carton wall adjacent the end edge of the reinforcement panel and if desired the end edge of the reinforcement panel adjacent the end of the carton through which the cans are loaded may be bevelled or may be otherwise configured so as to prevent damage to the carton due to loading of the cans.

6 Claims, 6 Drawing Figures

END LOADING CAN CARTON

TECHNICAL FIELD

This invention relates to end loading can cartons and more particularly is concerned with means for preventing damage to the top and bottom walls of such cartons when stacked one atop another due to coincidental relationships between the upper chimes of cans in a lower carton with respect to the lower chimes of the cans in an upper carton.

BACKGROUND ART

Cans of the so-called two piece type are constructed so that the lower ends thereof coincide with and are received by the recessed upper ends thereof so that when such cans are packaged in bulk in a container such as a corrugated paperboard container this nested relationship of cans enhances stability of the overall container and cans. Such can construction however may have deleterious effects when the cans are packaged in a can carton and then stacked one atop another due to the fact that coincident can chimes effect a "cookie cutting" operation whereby substantial damage may result. In order to preclude such damage, it is possible to separate the cans in one tier from the cans in another tier by a separating sheet formed for example of corrugated paperboard. Such an arrangement calls for special handling and generally is not desirable.

DISCLOSURE OF INVENTION

According to this invention in one form, an end loading can carton is reinforced by means of a reinforcing panel secured to the inner surface of either the top or bottom wall of the carton or to both such walls.

In order to facilitate entry of the cans through an end of an end loading carton without causing an undesired disruptive collision between the cans and the reinforcing panel or panels, an inwardly projecting embossed area may be formed on the top or bottom panel or to both such panels and at a location adjacent the end edge of the reinforcing panel and by this means to force the adjacent can end away from the adjacent top or bottom wall somewhat so as to minimize the disruptive effect of a collision between the cans and the end edge of one or both reinforcing panels. In addition and in accordance with a feature of this invention, the end edge of the reinforcing panel adjacent the end of the carton through which the cans are loaded may be bevelled inwardly and in a direction away from the horizontal panel to which it is adhered. And in like fashion the end edge of the reinforcing panel may be specially configured such as by a sinusoidal form so as to prevent damage to the end portion of the reinforcing panel. In order to prevent damage due to accumulation of moisture on the cans, it is desirable to apply a water resistant coating to the inner surface of the horizontally disposed top or bottom wall thereby to prevent moisture from penetrating such wall and from damaging the printed outer surface of the top or bottom wall.

BEST MODE OF CARRYING OUT THE INVENTION

Figure 1:
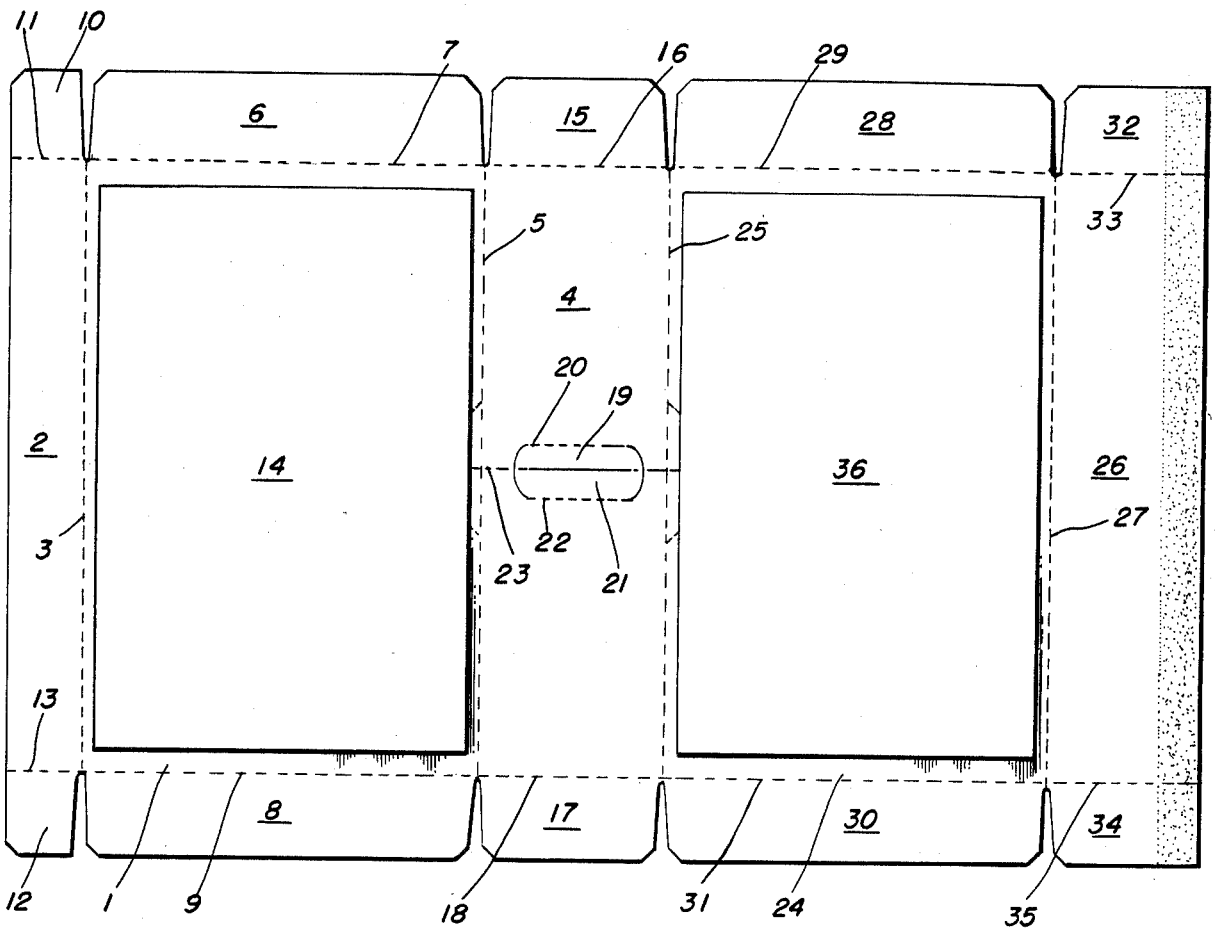
FIG. 1 is a plan view of a blank for an end loading carton as viewed from the inner surface thereof.

With particular reference to FIG. 1 the numeral 1 designates the bottom panel of an end loading carton formed according to this invention. A side wall panel 2 is foldably joined to bottom wall 1 along fold line 3 and a side wall 4 is foldably joined to bottom wall 1 along fold line 5. An end flap 6 is foldably joined to an end edge of bottom wall 1 along a fold line 7 while an end flap 8 is foldably joined to bottom wall 1 along fold line 9. Flap 10 is foldably joined to side wall panel 2 along fold line 11 while end flap 12 is foldably joined to side wall panel 2 along fold line 13.

In accordance with a feature of this invention, a reinforcing panel 14 is secured to the inner surface of bottom wall 1 and is slightly smaller than bottom wall 1.

End flap 15 is foldably joined to an end of side wall 4 along a fold line 16 and a similar end flap 17 is foldably joined to side wall 4 along a fold line 18.

For facilitating carrying of the carton, a handle panel 19 is foldably joined to side wall 4 along a fold line 20 and a similar panel 21 is foldably joined to side wall 4 along fold line 22. A center line slit 23 is formed in side wall 4 and extends into the adjacent portions of the associated bottom wall 1 and of the top wall 24. The hand carrying flaps 19 and 21 and associated structure are disclosed and claimed in U.S. patent application Ser. No. 655,217 filed Sept. 27, 1984 and owned by the assignee of this invention.

Top wall 24 is foldably joined to side wall 4 along fold line 25 and is foldably joined to side wall panel 26 along a fold line 27. End flap 28 is foldably joined to top wall 24 along a fold line 29 and end flap 30 is foldably joined to top wall 24 along fold line 31. In like fashion end flap 32 is foldably joined to side wall panel 26 along a fold line 33 and end flap 34 is foldably joined to side wall panel 26 along fold line 35.

Figure 2:
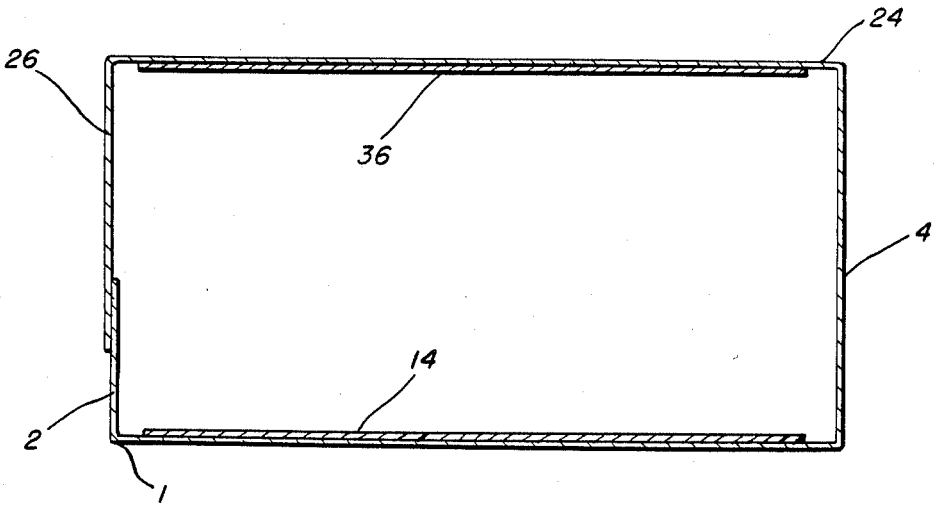
FIG. 2 is a cross sectional end view of a set up carton taken along a line such as that designated at 2—2 in FIG. 3.
Figure 3:
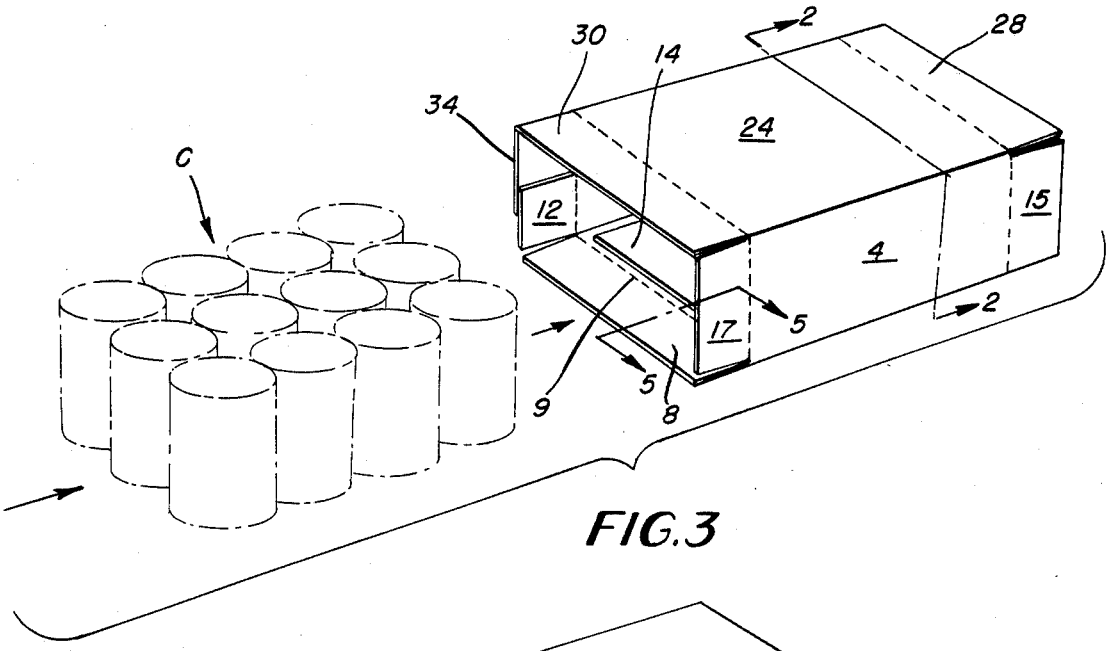
FIG. 3 is an isometric view of an end loading carton formed according to this invention and which demonstrates the beginning stages of the loading of a group of cans into the carton.
Figure 4:
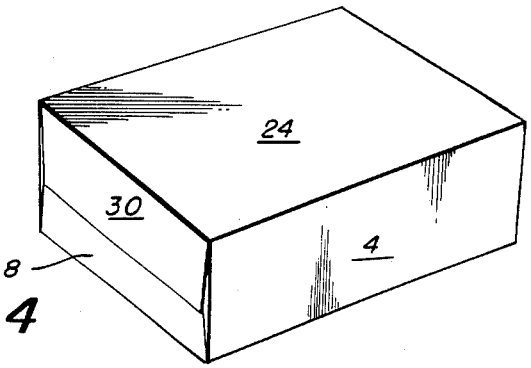
FIG. 4 is an isometric view of a completed package.

In accordance with a feature of this invention, reinforcing panel 36 which is similar to reinforcing panel 14 is secured to the inner surface of top wall 24. In order to form an open ended sleeve such as is shown in FIG. 3 from the blank depicted in FIG. 1, an application of glue is made to side wall panel 26 and to end flaps 32 and 34 as indicated by stippling in FIG. 1. Thereafter side wall panel 2 is folded upwardly and toward the right along fold line 3 and top wall 24 and side wall panel 26 are elevated and folded toward the left along fold line 25 to cause the stippled portion of side wall panel 26 to overlie and become adhered to side wall panel 2. Thereafter the carton when set up appears as shown in FIG. 2 in cross section.

Figure 5:
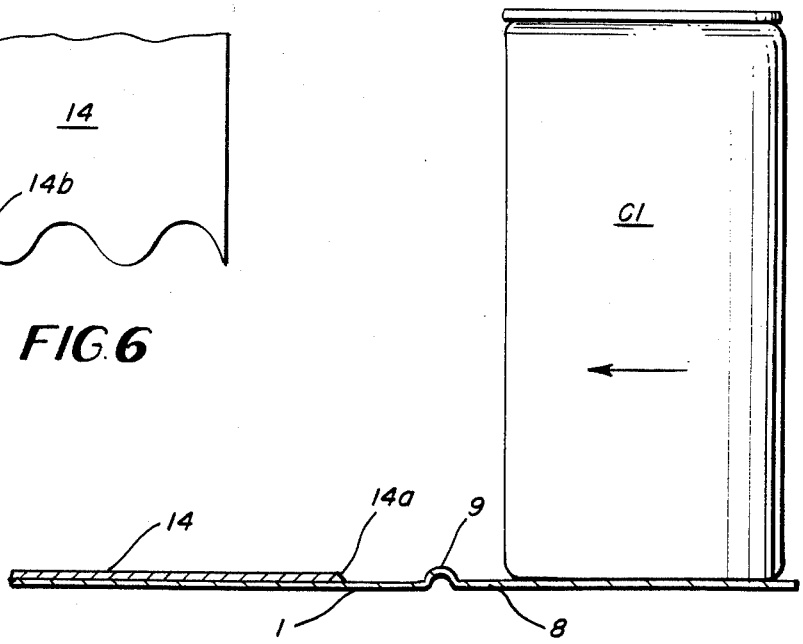

In FIG. 3, the end flaps 2, 26, 30, 17 and 8 are shown in open positions and the group of cans C is depicted in dotted lines and is moving toward the open end of the end loading carton. Movement of the cans into the carton conceivably could result in a disruptive collision between the cans and a reinforcement panel such as 14 or 36 or both. In order to guard against such disruption, and in accordance with one feature of this invention, the inwardly projecting embossment 9 as best shown in FIG. 5 is provided. Of course the effect of this embossment is to cause the cans such as C1 to ride upwardly somewhat and thus to minimize the possibility of a disruptive collision between the lower portion of can C1 and the outer edge of panel 14. In order further to minimize the possibility of damage, the edge 14*a* of reinforcement panel 14 may be inwardly bevelled as indicated in FIG. 5.

It will be understood that it is within the purview of this invention to use a reinforcement panel such as 14 in conjunction with the bottom wall such as 1 or to use a reinforcement panel such as 36 in conjunction with the top wall 24. Furthermore it is obvious that both reinforcement panels 14 and 36 may be used as is represented in FIGS. 1 and 2. If the top wall 24 is provided with a reinforcement panel 36 an inwardly and downwardly embossed fold line such as is indicated at 9 in FIG. 5 would be provided in conjunction with top wall panel 24 and would be coincidental or closely adjacent to the fold line 31.

In like fashion if the carton is loaded from both ends, it is obvious that appropriate embossed structure such as is indicated at 9 in FIG. 5 and the bevelled end portion such as is indicated at 14*a* in FIG. 5 could be provided at the opposite end of the carrier and such embossment would be either coincidental with or closely adjacent to the fold line such as 31 or 29 or to both such fold lines.

Figure 6:
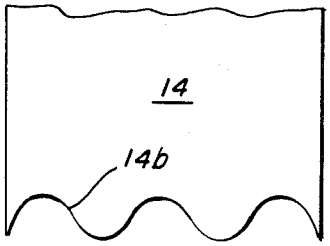
FIG. 5 is an enlarged but fragmentary view taken along the line designated 5—5 in FIG. 3 and which depicts certain features formed according to this invention and FIG. 6 is a fragmentary view of one end of a reinforcing panel which is specially configured according to a feature of this invention.

As an alternative or as an addition to the bevelled end edge such as 14*a* indicated in FIG. 5, it may be desirable to form the reinforcing panel such as 14 with a sinusoidal end edge such as is indicated at 14*b* in FIG. 6. Of course the sinusoidal edge 14*b* facilitates movement of the cans into overlying relationship with respect to the reinforcement panels such as 14 and 36.

Cans sometimes tend to accumulate water vapor. In order to preclude such moisture from penetrating the bottom wall 1 and the top wall 24, it may be desirable to apply a coating of water resistant material to the inner surface of bottom wall 1 and top wall 24. Such an application of water resistant material tends to cause the reinforcement panels such as 14 and 36 to absorb such moisture and would also preclude penetration of the moisture through the bottom wall 1 or the top wall 24 and would thus tend to prevent damage to the printed outer surfaces of these walls.

INDUSTRIAL APPLICABILITY

One or more reinforcement panels provided according to this invention together with associated features for facilitating end loading of the carton are particularly useful in preventing carton damage where cans having chimed rim portions are to be packaged where such carriers are to be stacked one atop another as is obvious.

We claim:

1. An end loading can carton comprising a normally horizontal bottom wall, a pair of side walls foldably joined respectively to opposite side edges of said bottom wall, a normally horizontal top wall foldably joined along the side edges thereof to the upper edges of said side walls respectively to form a sleeve with said side walls and the axes of the packaged cans in normal relation to said bottom and said top walls, an end flap foldably joined to each end of said bottom, top and side walls along a fold line which defines the associated end edge of the associated wall, and a reinforcing panel secured in flat face contacting relation to the inner surface of one of said normally horizontal walls for directly engaging the adjacent ends of the packaged cans, the fold line adjoining the end flap at one end of said one normally horizontal wall being inwardly embossed for engaging the adjacent ends of cans to be packaged during loading of the cans into the carton thereby to minimize possible disruptive engagement of the adjacent can ends with the adjacent end edge of said reinforcing panel.

2. An end loading can carton according to claim 1 wherein said adjacent end edge of said reinforcing panel is bevelled inwardly and away from the adjacent end of the carton to facilitate entry of the cans into the carton by avoiding disruptive collision of the cans with said adjacent end edge of said reinforcing panel.

3. An end loading can carton according to claim 1 wherein the inner surface of said one of said normally horizontal walls is coated with a water resistant material to cause water condensate on the cans to be absorbed by said reinforcing panel and to prevent water penetration of said one of said normally horizontal walls and possible blemish of the outer printed surface thereof.

4. An end loading can carton according to claim 1 wherein a reinforcing panel is secured in flat face contacting relation with the inner surface of said top and said bottom walls and wherein the fold line adjoining the end flap at one end of said top and bottom wall is inwardly embossed.

5. An end loading can carton according to claim 1 wherein said adjacent end edge of said reinforcing panel is spaced inwardly from the adjacent end of the carton by a distance substantially less than one-half the diameter of a can.

6. An end loading can carton according to claim 1 wherein said reinforcing panel is slightly smaller in area than its associated normally horizontal panel and wherein its edges are spaced from the corresponding edges of its associated normally horizontal panel by a distance less than one-half of a can diameter.

* * * * *